US005767809A

United States Patent [19]

Chuang et al.

[11] Patent Number: 5,767,809

[45] Date of Patent: Jun. 16, 1998

[54] OMNI-DIRECTIONAL HORIZONTALLY POLARIZED ALFORD LOOP STRIP ANTENNA

[75] Inventors: Huey-Ru Chuang, Tainan; Tzyy-Sheng Horng, Taichung; Jin-Won Pan, Kaoshiung; Chung-Ho Wang, Taipei, all of Taiwan

[73] Assignee: Industrial Technology Research Institute, Hsinchu, Taiwan

[21] Appl. No.: 611,948

[22] Filed: Mar. 7, 1996

[51] Int. Cl.[6] ..... H01Q 1/38; H01Q 1/24

[52] U.S. Cl. ..... 343/700 MS; 343/702; 343/741

[58] Field of Search ..... 343/702, 700 MS, 343/741, 742, 743, 744, 748, 866, 867, 868

[56] References Cited

U.S. PATENT DOCUMENTS 2,749,544 6/1956 Pike ..... 343/742

4,547,776 10/1985 Bolt, Jr. et al. ..... 343/741

*Primary Examiner*—Donald T. Hajec

*Assistant Examiner*—Tan Ho

*Attorney, Agent, or Firm*—Meltzer, Lippe, Goldstein, Wolf & Schlissel, P.C.

[57] ABSTRACT

An antenna is disclosed with a first Z-shaped strip resonant element disposed in a first plane. The first strip resonant element has first and second identical sized and shaped, parallel, longitudinal strip segments. The first strip resonant element also has a third segment which connects diagonally opposite ends of the first and second strip segments. The antenna also has a second Z-shaped strip resonant element disposed in a second plane that is parallel to the first plane. The second strip resonant element has fourth and fifth identical sized and shaped, parallel longitudinal strip segments. The second strip resonant element also has a sixth segment, having identical dimensions and an identical shape as the third segment, which connects diagonally opposite ends of the fourth and fifth segments. The second Z-shaped strip resonant element is disposed in the second plane so that the sixth segment overlies said third segment and so that said first, second, fourth and fifth segments overlie a rectangle.

6 Claims, 14 Drawing Sheets

CASE1: $L=1/4\lambda$

CASE2: $L=1/40\lambda$

OMNI-DIRECTIONAL HORIZONTALLY POLARIZED ALFORD LOOP STRIP ANTENNA

RELATED APPLICATION

U.S. patent application Ser. No. 08/578,881, entitled "Non-Coplanar, Resonant Element, Printed Circuit Board Antenna," was filed on Dec. 22, 1995 for Chewnpu Jou. The above-noted application is assigned to the assignee of this application. The contents of the above-noted application are relevant to the subject matter of this application and are incorporated herein by reference.

1. Field of the Invention

The present invention relates to antennas which may be used in portable personal communication devices such as cellular telephones.

2. Background of the Invention

FIG. 1 shows a conventional portable hand held communications transceiver 10 in an environment of use 12. As shown, the portable communications transceiver 10 is a cellular telephone. Typically, such cellular telephones are used in an environment with radio wave scattering structures such as office buildings. As shown in FIG. 1, a radio wave signal emitted by the transceiver 10 initially has a vertical polarization.

After being reflected by the buildings in the environment 12, the polarization of the emitted signal may change to horizontal. The same is true for signals emitted by another device, such as a cell base station, which signals are to be received by the transceiver 10.

Ideally, a conventional transceiver 10 with a dipole antenna emits a vertically polarized signal. This is illustrated in FIG. 2. As shown, the ideal emitted signal from the dipole has an omni-directional vertical-polarization ($E_{74}$) field.

As noted above, the signal emitted from the transceiver 10, or the signal to be received by the transceiver 10, may have its polarity altered by the environment 12. It is thus desirable to supplement the vertically polarized dipole antenna with a horizontally polarized antenna.

The prior art has suggested loop antennas for transmitting and receiving horizontally polarized signals. This is because a loop antenna will have a horizontal polarization field pattern. The problem is that small loop antennas, which would be required for the portable personal communications transceiver 10, with the desired uniform current, have a small radiation resistance and a high reactance. The radiation resistance can be increased by increasing the dimensions of the loop antenna. However, as the antenna dimensions are increased, the current distribution becomes more non-uniform and therefore reduces the omni-directionality of the radiation field pattern. This is illustrated in FIGS. 3–5. FIG. 3 shows a simple square loop antenna with side-to-side dimension L. FIG. 4 illustrates simulated emitted field patterns for the H-plane $\theta=90°$ x-y plane, E-plane $\phi=90°$ y-z plane and E-plane $\phi=0°$ x-z plane for an antenna with dimension $L=\frac{1}{4}\cdot\lambda$. (Note $\lambda=c/f$.). FIG. 5 illustrates simulated emitted field patterns for the H-plane $\theta=90°$ x-y plane, E-plane $\phi=90°$ y-z plane and E-plane $\phi=0°$ x-z plane for an antenna with dimension $L=\frac{1}{4}\cdot\lambda$. As shown, the x-y and y-z plane field patterns in FIG. 5 exhibit less uniformity (more variance with direction) than those in FIG. 4.

FIGS. 6–9 illustrate a number of loop design antennas. FIG. 6 depicts a small loop antenna. FIG. 7 depicts a clover leaf design antenna. FIG. 8 depicts a triangular loop design antenna. FIG. 9 depicts an Alford loop design antenna. See J. KRAUS, ANTENNAS, 2d ed., ch. 16 (1988). Of particular interest is the Alford loop shown in FIG. 9. In the Alford loop antenna of FIG. 9, an antenna current flows from feed points F and F' along conductors arranged in the shape of a square. The length L is advantageously set to $\frac{1}{4}\cdot\lambda$.

In addition to providing a horizontally polarized antenna, it is desirable to provide such an antenna which is easy to fabricate.

The prior art has proposed forming antennas from thin conductors as opposed to circular cross-sectioned conductors. FIG. 10 illustrates an antenna 20 referred to as a "coupled microstrip patch antenna." The coupled microstrip patch antenna 20 includes plural, e.g., three, resonator patches 22, 24 and 26 which are all located in the same plane. Illustratively, the antenna shown in FIG. 10 is designed for 2.4 GHz. FIG. 11 illustrates the variation of the reflection coefficient in relation to frequency. As shown, the bandwidth of the antenna 20 is limited to about 1%.

FIG. 12 illustrates a multi-layered microstrip patch antenna 30 disclosed in U.S. Pat. No. 4,401,988. A feed pin 31, of a coaxial cable 32 is connected to a radiating element patch 33. The radiating element patch 33 is affixed to a dielectric substrate 34 which separates the radiating element patch 33 from a parasitic element 35. The parasitic element 35 is affixed to another dielectric 36 which separates the parasitic element 35 from a ground plane layer 37. The coupling effect between the radiating element patch 33 and the parasitic element 35 enhances the radiation at angles closer to the ground plane. Compare FIG. 13, which shows a field pattern for the single layer microstrip patch antenna 20 of FIG. 10, to FIG. 14, which shows a field pattern for the multi-layered microstrip patch antenna 30 of FIG. 12. Note the field pattern as the elevation increases from ground level beyond 45°. The maximum field value occurs at 90° from ground level, i.e., at right angles to the patches. When the coupled microstrip patch antenna 20 is arrayed, the beam is typically even narrower.

The problem with the coupled microstrip patch antenna and the multi-layered patch antenna is their highly directional beam. As noted above, in small portable communications devices, it is desirable for an antenna to achieve the contrary effect—to produce an omni-directional field pattern. This ensures good reception regardless of how the antenna is oriented in regard to the other transceiver. Furthermore, the coupled microstrip patch antenna must be assembled manually.

It is an object of the present invention to overcome the disadvantages of the prior art. It is also an object of the present invention to provide an antenna which can be manufactured using printed circuit board technology.

SUMMARY OF THE INVENTION

These and other objects are achieved by the present invention. According to one embodiment, an antenna is provided with a first Z-shaped strip resonant element disposed in a first plane. The first strip resonant element has first and second identical sized and shaped, parallel, longitudinal strip segments. The first strip resonant element also has a third segment which connects diagonally opposite ends of the first and second strip segments. The antenna also has a second Z-shaped strip resonant element disposed in a second plane that is parallel to the first plane. The second strip resonant element has fourth and fifth identical sized and shaped, parallel longitudinal strip segments. The second strip resonant element also has a sixth segment, having identical dimensions and an identical shape as the third segment, which connects diagonally opposite ends of the fourth and fifth segments. The second Z-shaped strip resonant element is disposed in the second plane so that the sixth segment overlies the third segment and so that the first, second fourth and fifth segments overlie a rectangular shaped boundary.

Advantageously, such an antenna may be formed by laying out Z-shaped strip conductors on a printed circuit board. The printed circuit board serves as a planar dielectric disposed in a third plane that is parallel to the first and second planes. The planar dielectric is disposed between the first and second Z-shaped strip resonant elements.

Illustratively, a first feed is provided in the center of the third strip segment and a second feed is provided in the center of the sixth strip segment. A first signal is applied at the first feed and an opposite polarity of the first signal is applied as a second signal to the second feed. The first signal causes an antenna current to flow on the third strip segment in opposing directions towards the diagonally opposing corners (to which the third strip segment is connected) of the first and second strip segments. The antenna current then flows on the first and second segments to the ends opposite those to which the third segment is connected. The second signal causes an antenna current to flow in the fourth and fifth segments from the ends opposite the diagonal opposing ends (to which the sixth segment is attached). The antenna current flows on the fourth and fifth segments to the diagonally opposing ends to which the sixth segment is connected. The antenna current then flows on the sixth segment from the fourth and fifth segments towards the second signal feed.

In short, an antenna is provided which radiates a fairly omni-directional horizontally polarized signal. The antenna can be made sufficiently small to fit in a portable hand-held transceiver. Furthermore, the antenna can be simply and easily manufactured using printed circuit board technology.

DETAILED DESCRIPTION OF THE INVENTION

Figure 1:
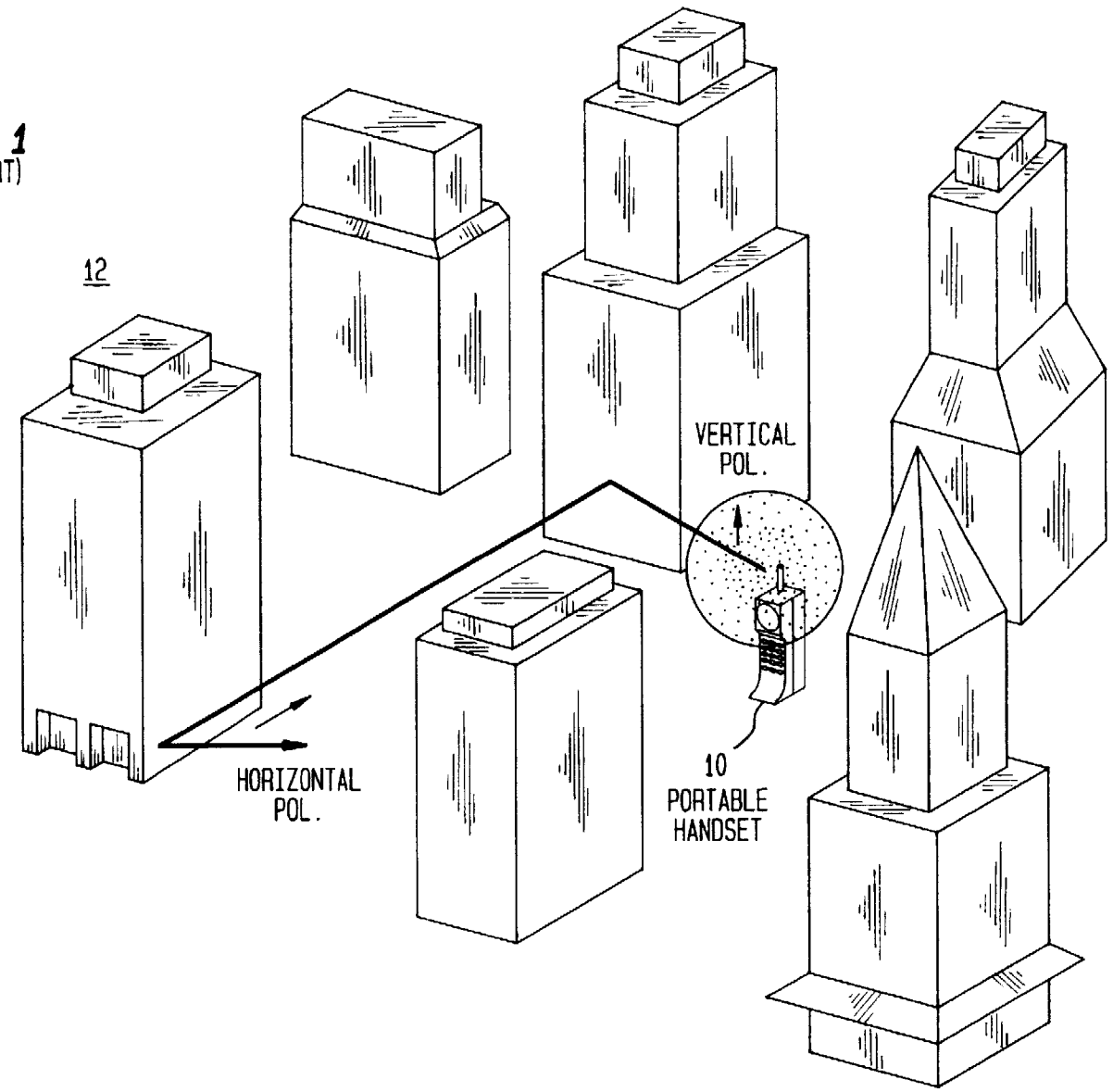
FIG. 1 (PRIOR ART)
FIG. 1 shows a conventional portable hand held communications transceiver in a typical communications environment.
Figure 2:
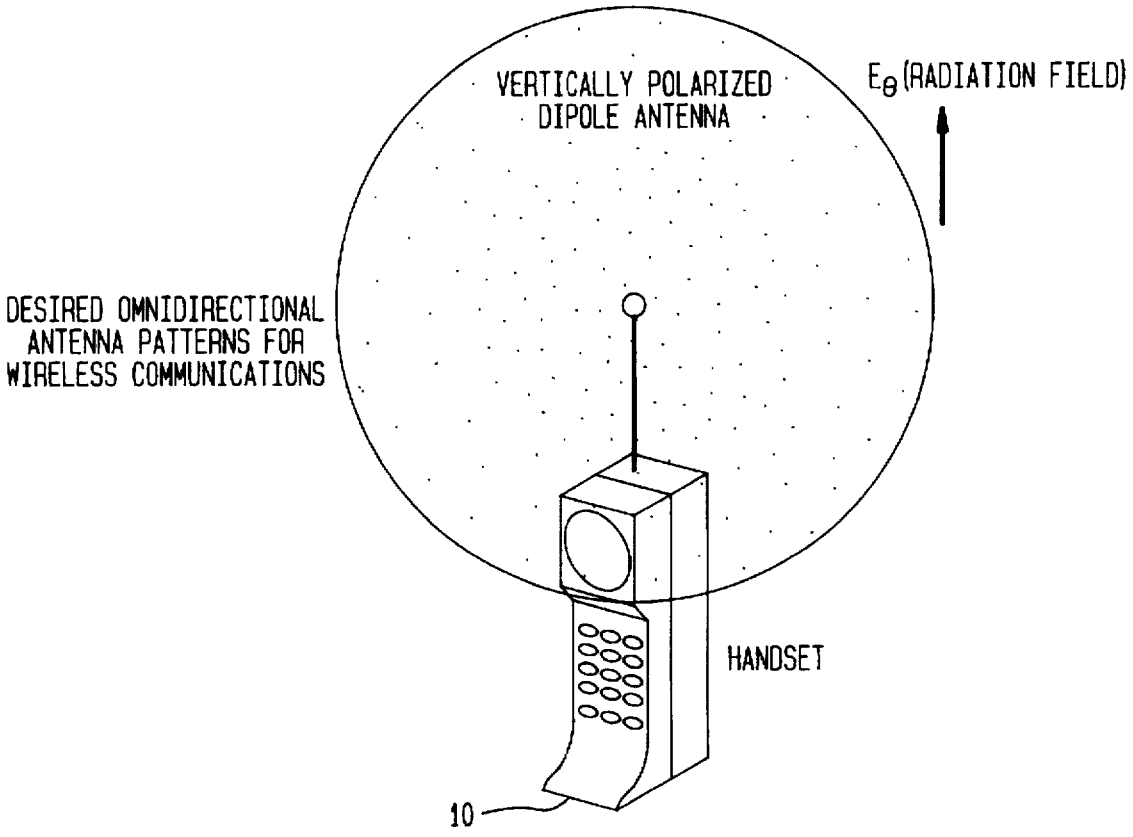
FIG. 2 (PRIOR ART)
FIG. 2 shows an ideal radiated pattern from a conventional dipole antenna.
Figure 3:
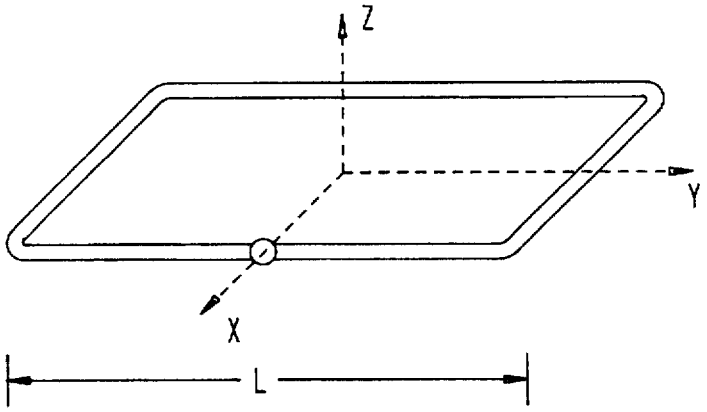
FIG. 3 (PRIOR ART)
FIG. 3 shows a conventional rectangular loop antenna.
Figure 4:
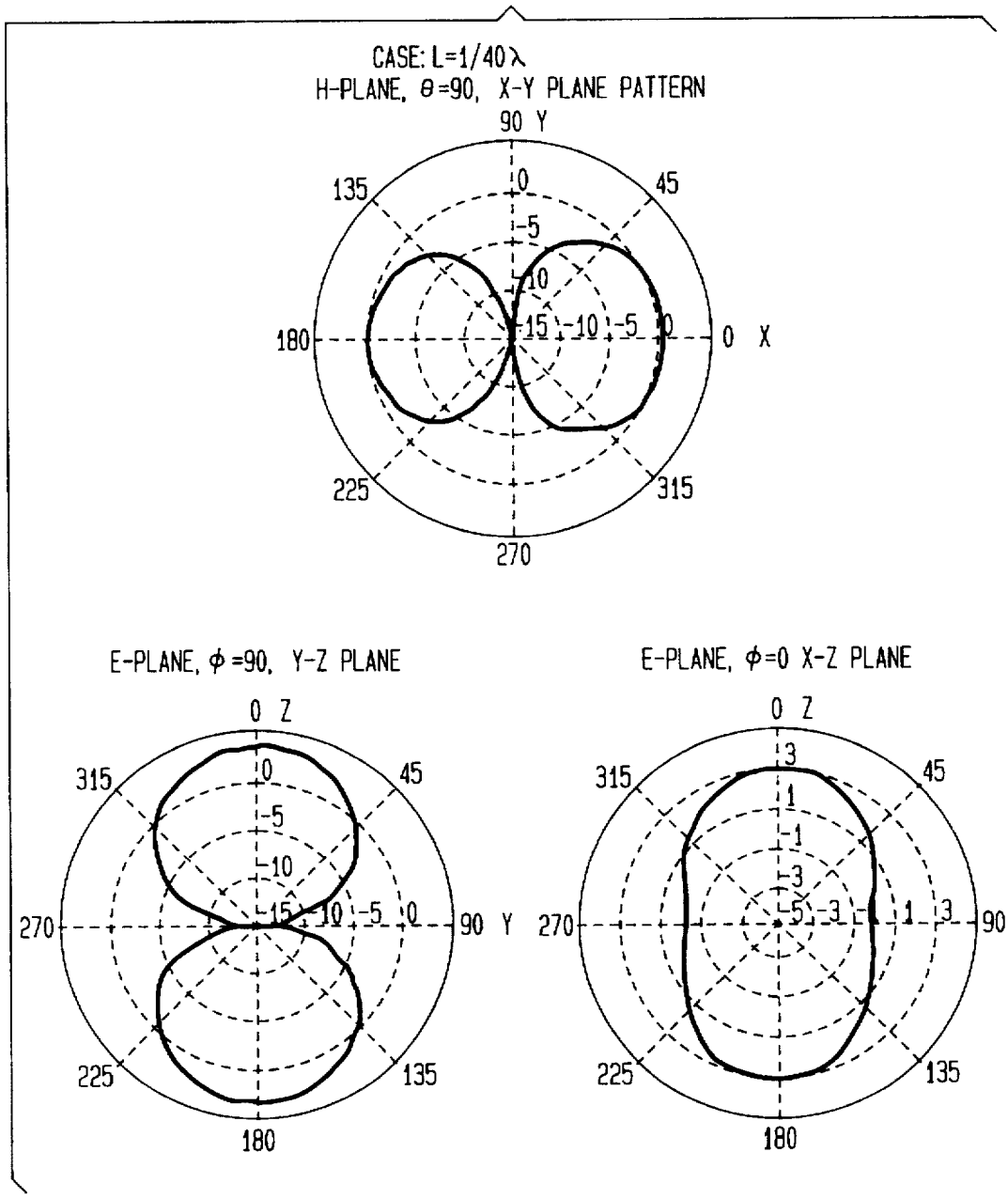
FIG. 4 (PRIOR ART)
FIG. 4 shows the field patterns for a $\frac{1}{40}\cdot\lambda$. A size rectangular loop antenna.
Figure 5:
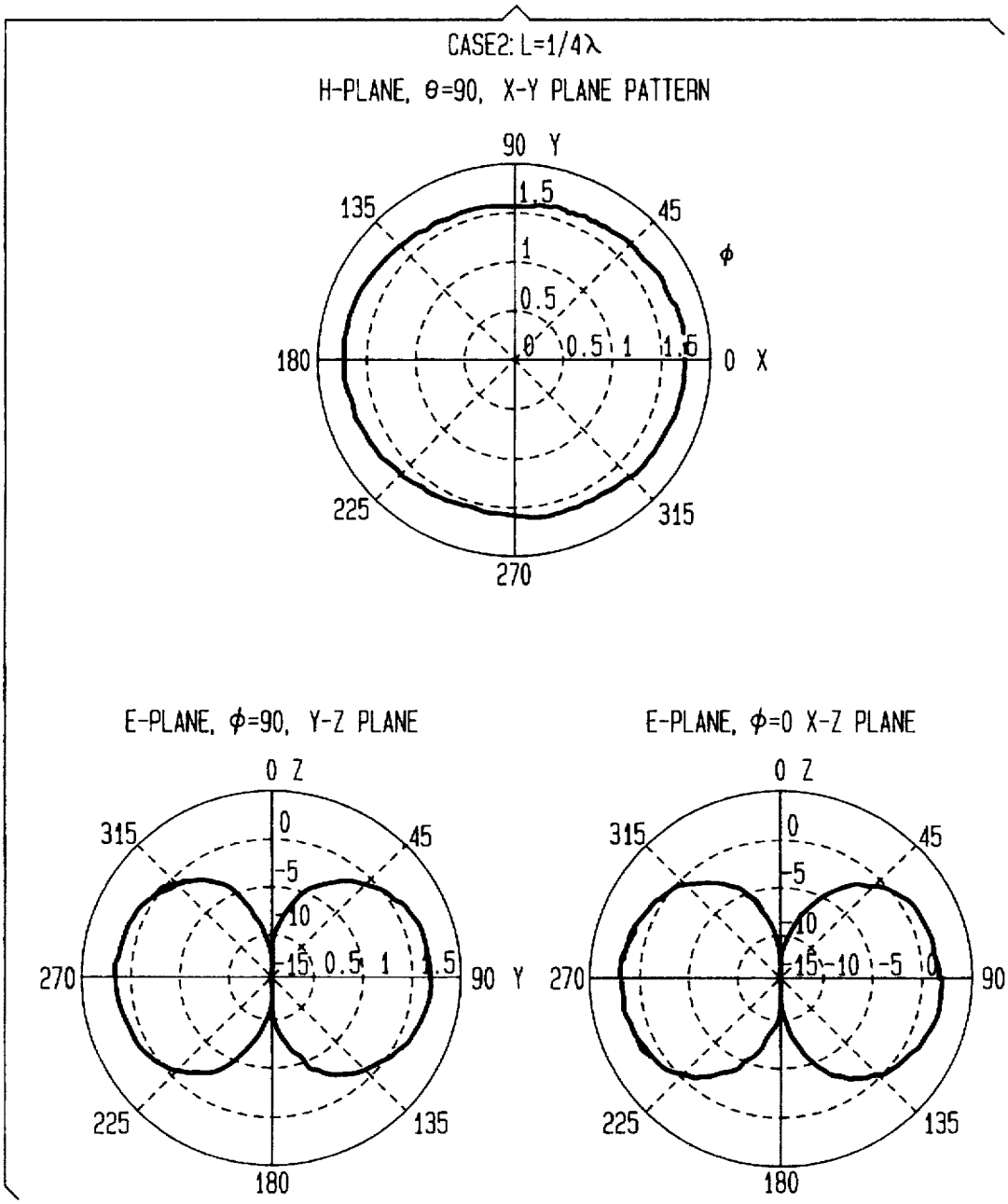
FIG. 5 (PRIOR ART)
FIG. 5 shows the field patterns for a $\frac{1}{4}\cdot\lambda$. A size rectangular loop antenna.
Figure 6:
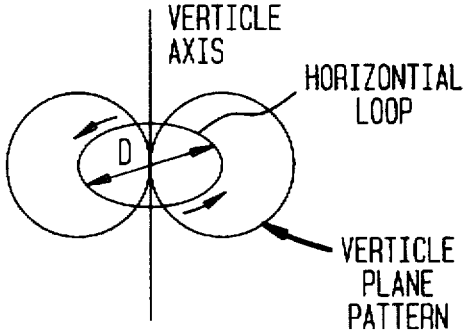
FIG. 6 (PRIOR ART)
FIG. 6 shows a conventional horizontal loop antenna.
Figure 7:
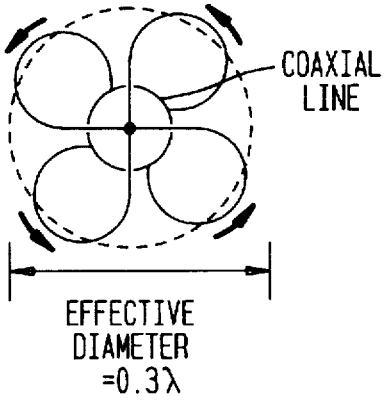
FIG. 7 (PRIOR ART)
FIG. 7 shows a conventional clover leaf antenna.
Figure 8:
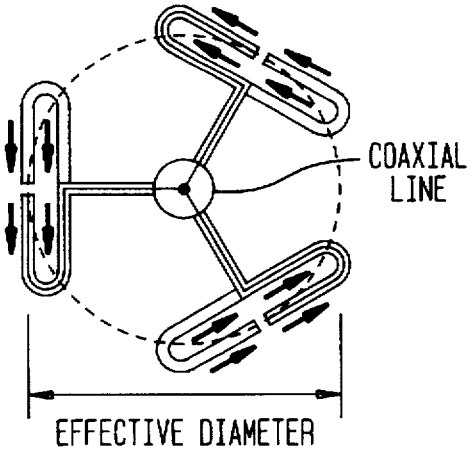
FIG. 8 (PRIOR ART)
FIG. 8 shows a conventional triangular loop antenna.
Figure 9:
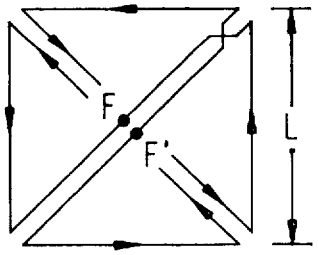
FIG. 9 (PRIOR ART)
FIG. 9 shows a conventional Alford loop antenna.
Figure 10:
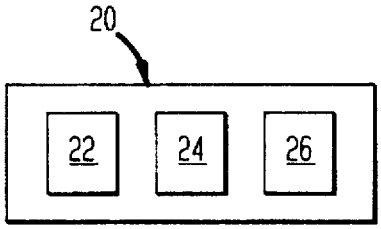
FIG. 10 (PRIOR ART)
FIG. 10 shows a conventional coupled microstrip patch antenna.
Figure 11:
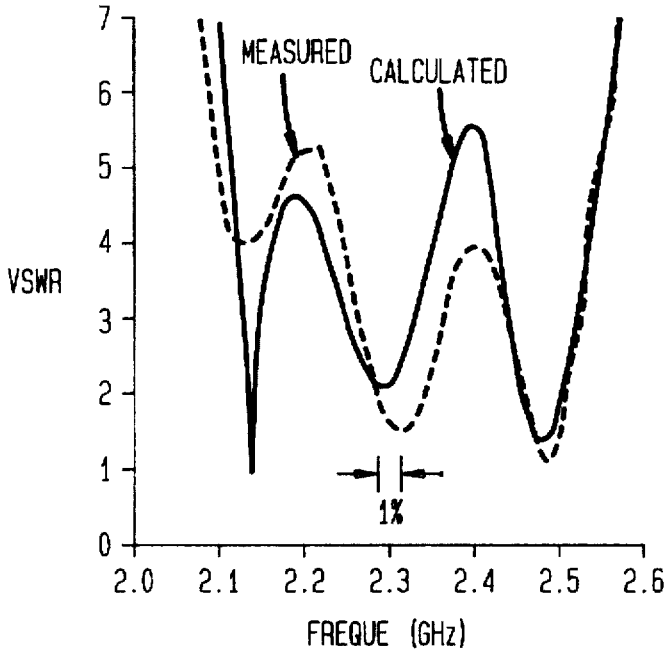
FIG. 11 (PRIOR ART)
FIG. 11 shows a graph of the reflection coefficient with respect to frequency for the antenna of FIG. 10.
Figure 12:
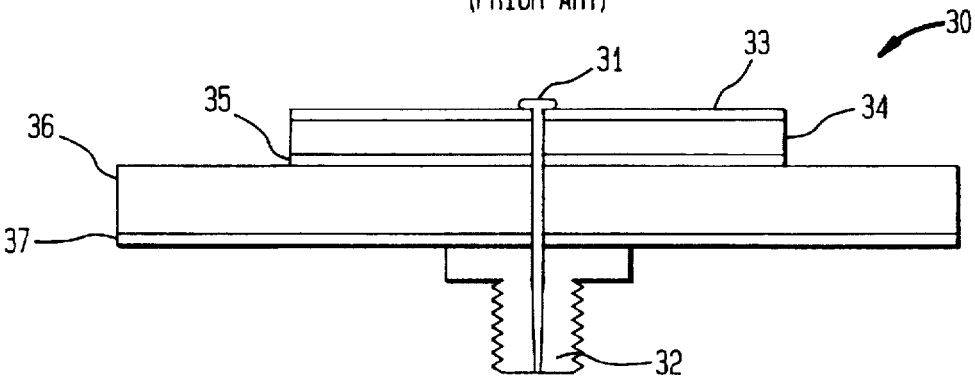
FIG. 12 (PRIOR ART)
FIG. 12 shows a conventional multi-layer microstrip patch antenna.
Figure 13:
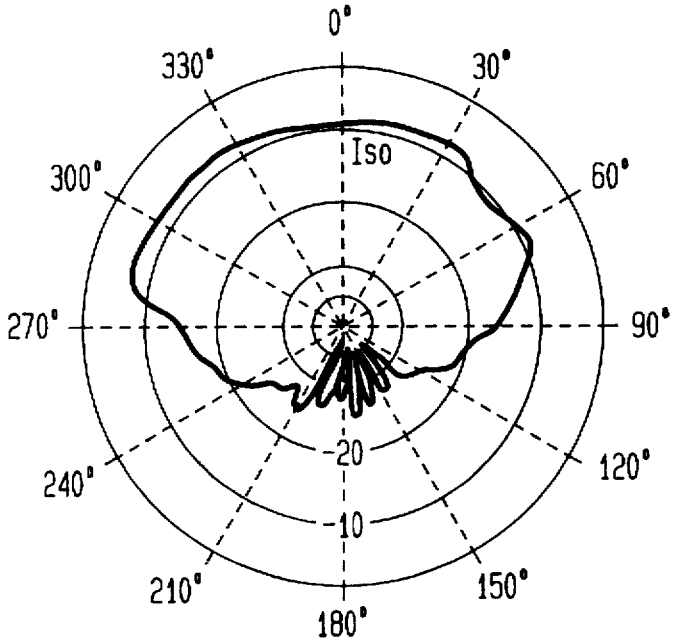
FIG. 13 (PRIOR ART)
FIG. 13 shows a field pattern for the antenna of FIG. 10.
Figure 14:
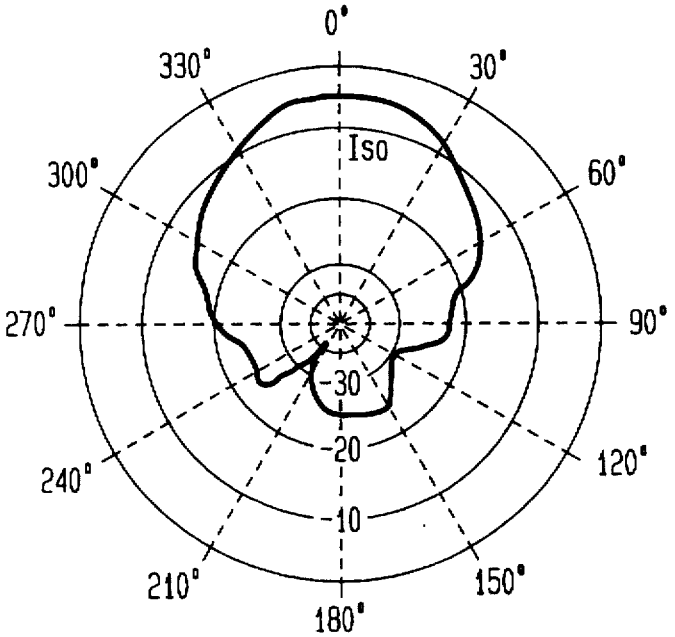
FIG. 14 (PRIOR ART)
FIG. 14 shows a field pattern for the antenna of FIG. 12.
Figure 15:
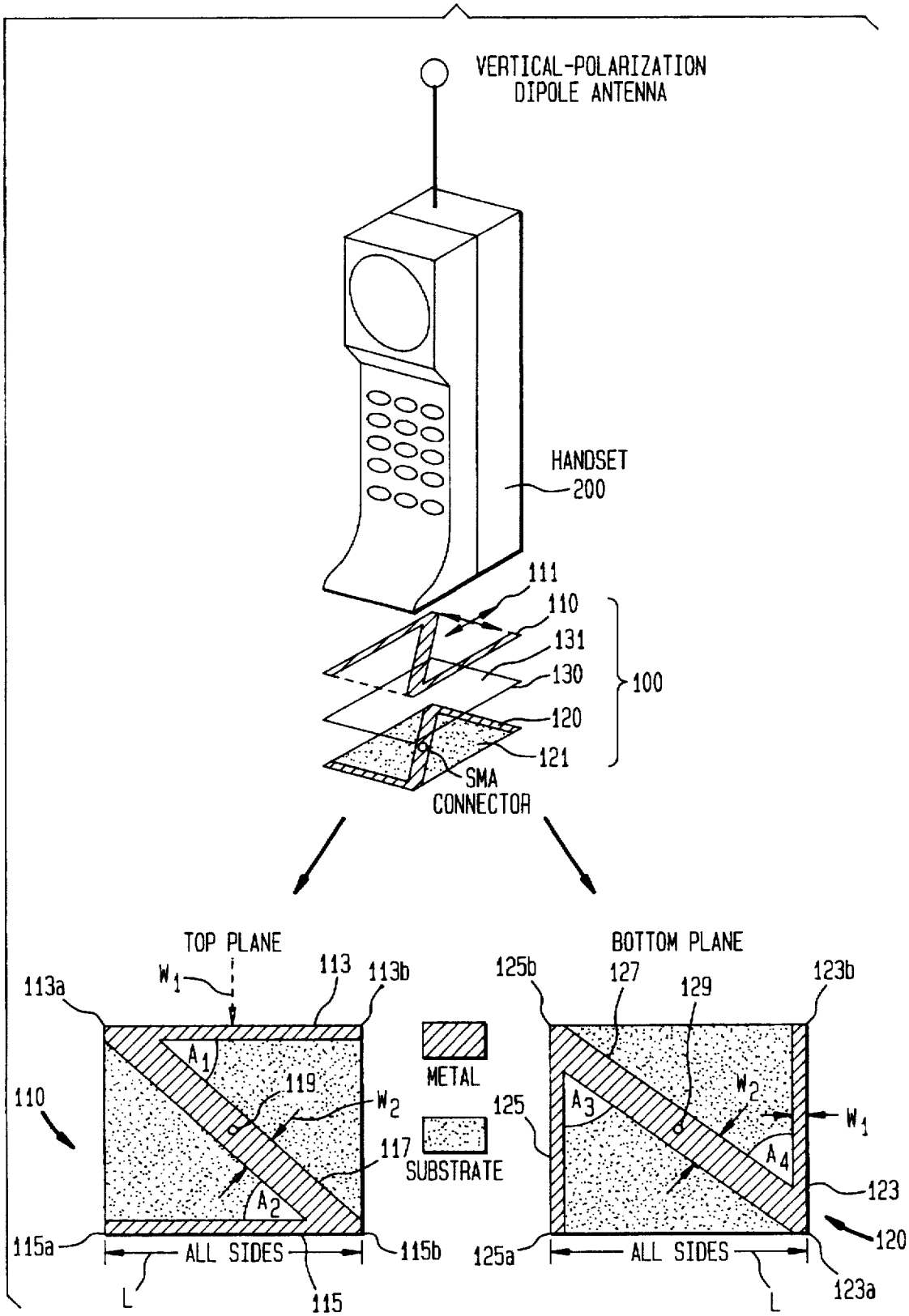
FIGS. 15–16 shows an antenna according to an embodiment of the present invention.
Figure 16:
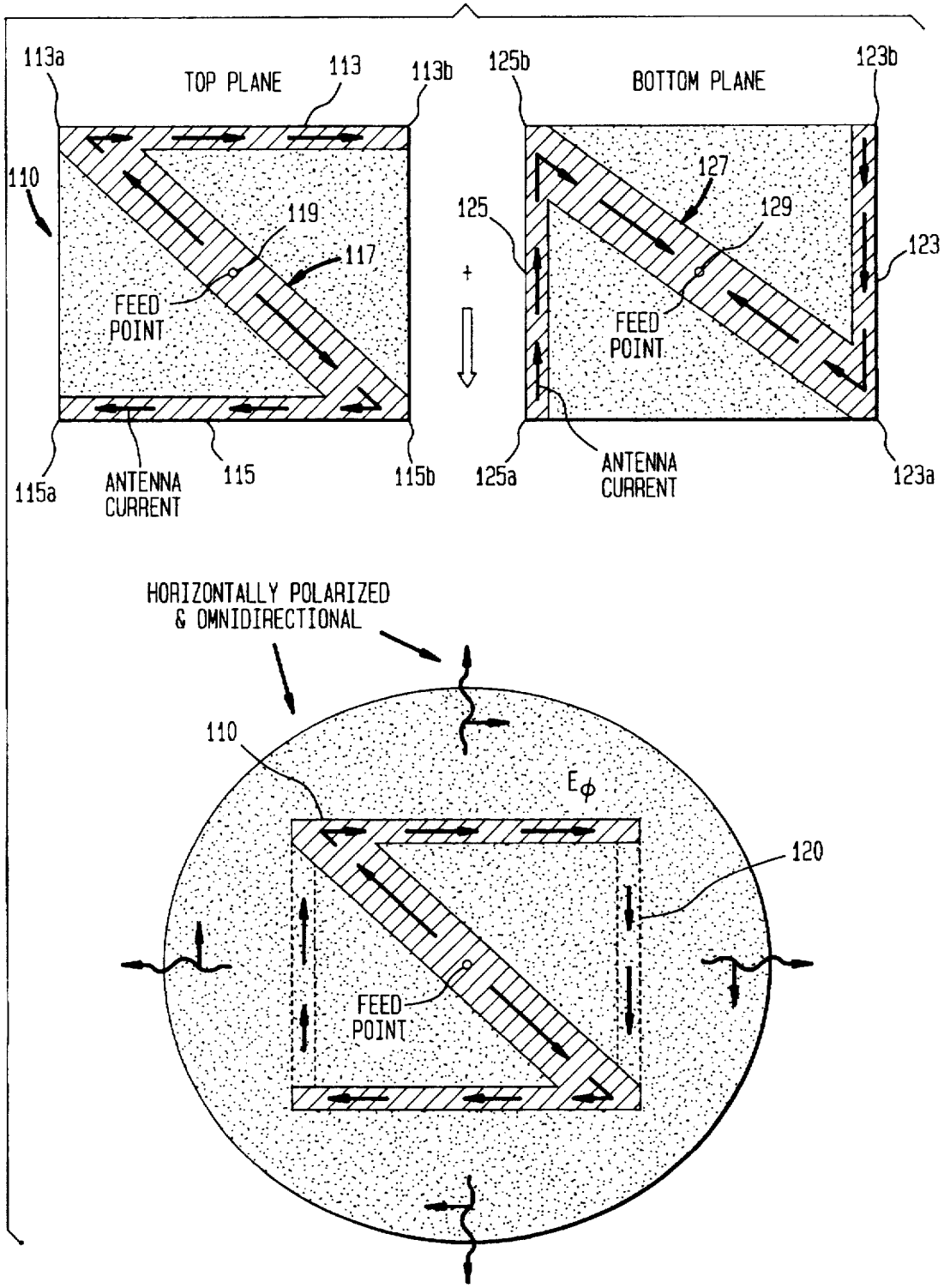

FIGS. 15–16 shows an antenna 100 according to an embodiment of the present invention. Illustratively, the antenna 100 forms part of a portable hand held communications transceiver 200, such as a cellular telephone. The antenna 100 includes two Z-shaped strip resonant elements 110 and 120 and a dielectric 130. Illustratively, the resonant elements 110 and 120 are metallic strip conductors that are laid out on a printed circuit board, such as an FR-4 glass-epoxy substrate.

The resonant element 110 lies in a first plane 111. The resonant element 110 includes two longitudinal strip segments 113 and 115 or "wings." The strip segment 113 is parallel to the strip segment 115. Each strip segment has ends 113*a*, 113*b* or 115*a*, 115*b*. The strip segments 113 and 115 have identical dimensions/sizes. Furthermore, the ends 113*a* and 115*a* and the ends 113*b* and 115*b* are aligned—the shortest line between the ends 113*a* and 115*a* is perpendicular to the strip segments 113 and 115. Likewise, the shortest line between the ends 113*b* and 115*b* is perpendicular to both the strip segments 113 and 115.

The diagonally opposing ends 113*a* and 115*b* are connected together by a third strip segment 117 or "arm." Illustratively the angles A1 and A2 are both equal to 45°. The strip segments 113, 115 and 117 are illustratively integral.

The resonant element 120 lies in a second plane 121 that is parallel to the first plane 111. The resonant element 120 includes two longitudinal strip segments 123 and 125. The strip segment 123 is parallel to the strip segment 125. Each strip segment 123 and 125 has two ends 123*a*, 123*b* or 125*a*, 125*b*. The strip segment 123 and 125 have identical dimensions/sizes which are identical to the strip segments 113 and 115. Furthermore, the ends 123*a* and 125*a* and the ends 123*b* and 125*b* are aligned—the shortest line between the ends 123*a* and 125*a* is perpendicular to the strip segments 123 and 125. Likewise, the shortest line between the ends 123*b* and 125*b* is perpendicular to both the strip segments 123 and 125.

The diagonally opposing ends 123*a* and 125*b* are connected together by a third strip segment 127 or "arm." Illustratively the angles A3 and A4 are both equal to 45°. The strip segments 123, 125 and 127 are illustratively integral.

The dielectric 130 lies in a third plane 131 that is parallel to the planes 111 and 121. The dielectric is sandwiched between the resonant element 110 and the resonant element 120.

Note that the resonant elements 110 and 120 have a "Z" shape. The resonant elements 110 and 120 are oriented with respect to each other such that the strip segments 127 and 117 overlap. The strip segments 117 and 127 have identical dimensions; therefore, the strip segment 127 entirely overlies the strip segment 117. Note also that the strip segments 113, 115, 123 and 125 lie on a rectangular shaped boundary. Essentially, the strip segments 113, 115, 123 and 125 form a rectangular shaped loop.

The resonant element 110 has a feed 11 9 and the resonant element 120 has a feed 129. The signal fed to the feed 129 is the opposite polarity of the signal fed to the feed 119. The signal fed to the feed 119 illustratively produces an antenna current in the strip segment 117. The antenna current flows in opposite directions away from the feed 119 to the diagonally opposing ends 113*a* and 115*b* of the strip segments 113 and 115. The antenna current then flows on the strip segments 113 and 115 towards the ends 113*b* and 115*a*, respectively. The signal fed to feed 129 produces oppositely directed antenna currents in the strip segments 123 and 125. The antenna current produced in the strip segment 123 flows from the end 123*b* to the end 123*a*. The antenna current produced in the strip segment 125 flows from the end 125*a* to the end 125*b*. The antenna currents then flow on the strip segment 127 from the end of strip segment 123*a* and the end of the strip segment the feed 125*b* towards the feed 129.

The antenna current flowing in the resonant elements 110 and 120 establishes a rectangular loop type current. Such a current radiates a horizontally polarized electromagnetic wave. As shown, the emitted signals are polarized in a direction that is parallel to the strip segments 113, 115, 123 and 125. Illustratively, the distance between the strip segments 117 and 127 is very small. Thus, the electromagnetic fields radiated from these two strip segments 117 and 127 approximately cancel.

The dimensions L, w1 and w2 are chosen according to the frequency of the signal applied to the feeds 119 and 129 and the impedance of the source which provides the signal to the feeds 119 and 129. Illustratively the frequency is 915 MHZ which is the center frequency of the 902–928 ISM band. As noted above, L is set equal to $\frac{1}{4}\cdot\lambda$ in an Alford loop. However, this provides only a rough value of L.

The values of L, w1 and w2 are illustratively determined through simulation. Illustratively, the resonant elements 110 and 120 are modeled as containing smaller square and triangular shaped regions (wherein each triangle is a 45° right triangle whose equal length sides have a length equal to a side of the squares). The current distribution is then determined in each of the squares and triangles via simulation using the spectral-domain electric field integral equation. The dimensions which produce the most optimal current distribution are then selected. Illustratively, the following assumptions were made in the simulation:

source impedance=50Ω modeling square size=72.5 mil×72.5 mil dielectric 130 thickness=1.6 mm, dielectric relative permitivity $\epsilon_r$=4.7

Under these assumptions, the following dimensions for L, w1 and w2 were illustratively determined:

L=42.35 mm w1=3.68 mm w2=7.81 mm

Figure 17:
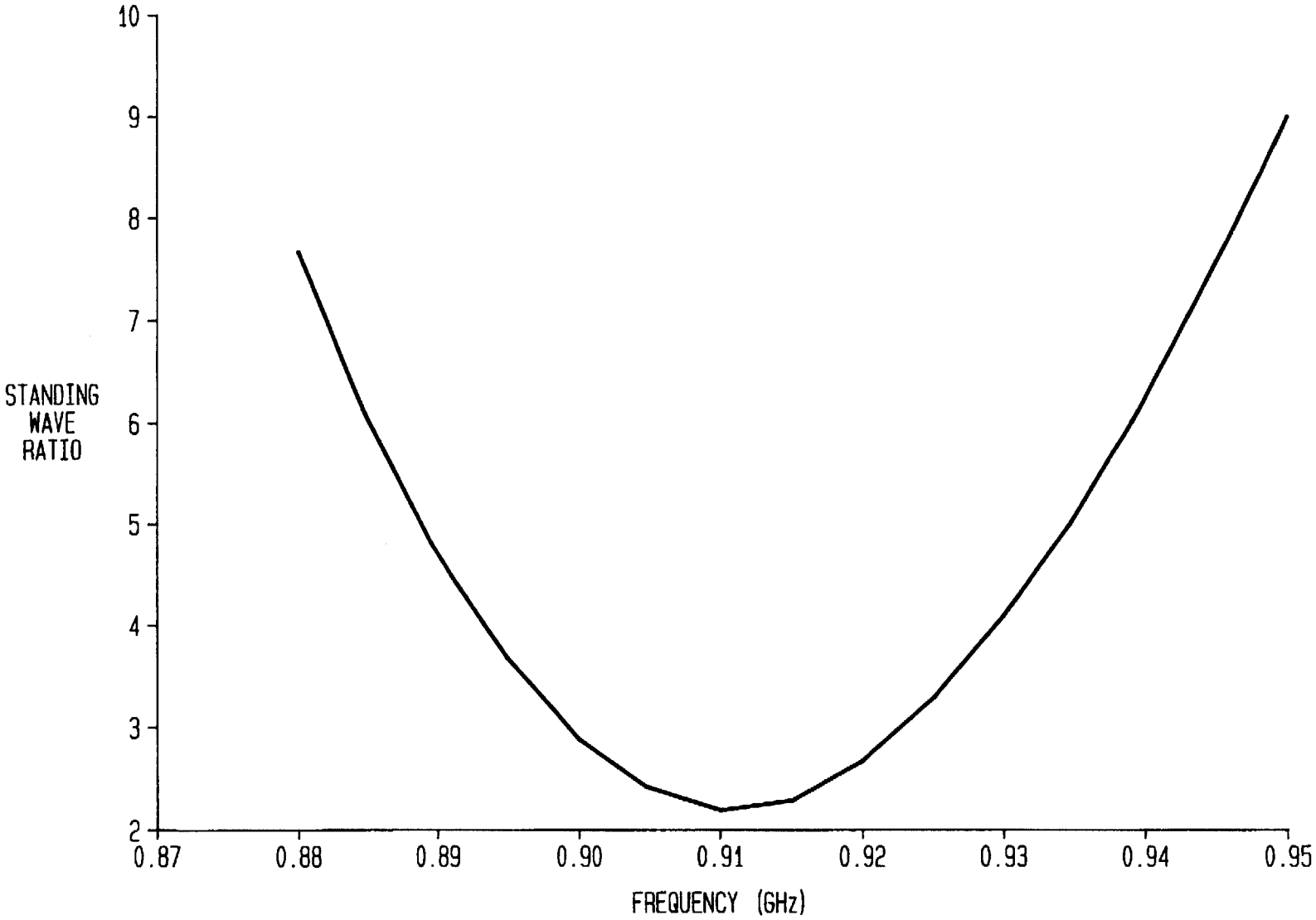
FIG. 17 shows the calculated SWR of a simulated antenna according to an embodiment of the present invention.
Figure 18A:
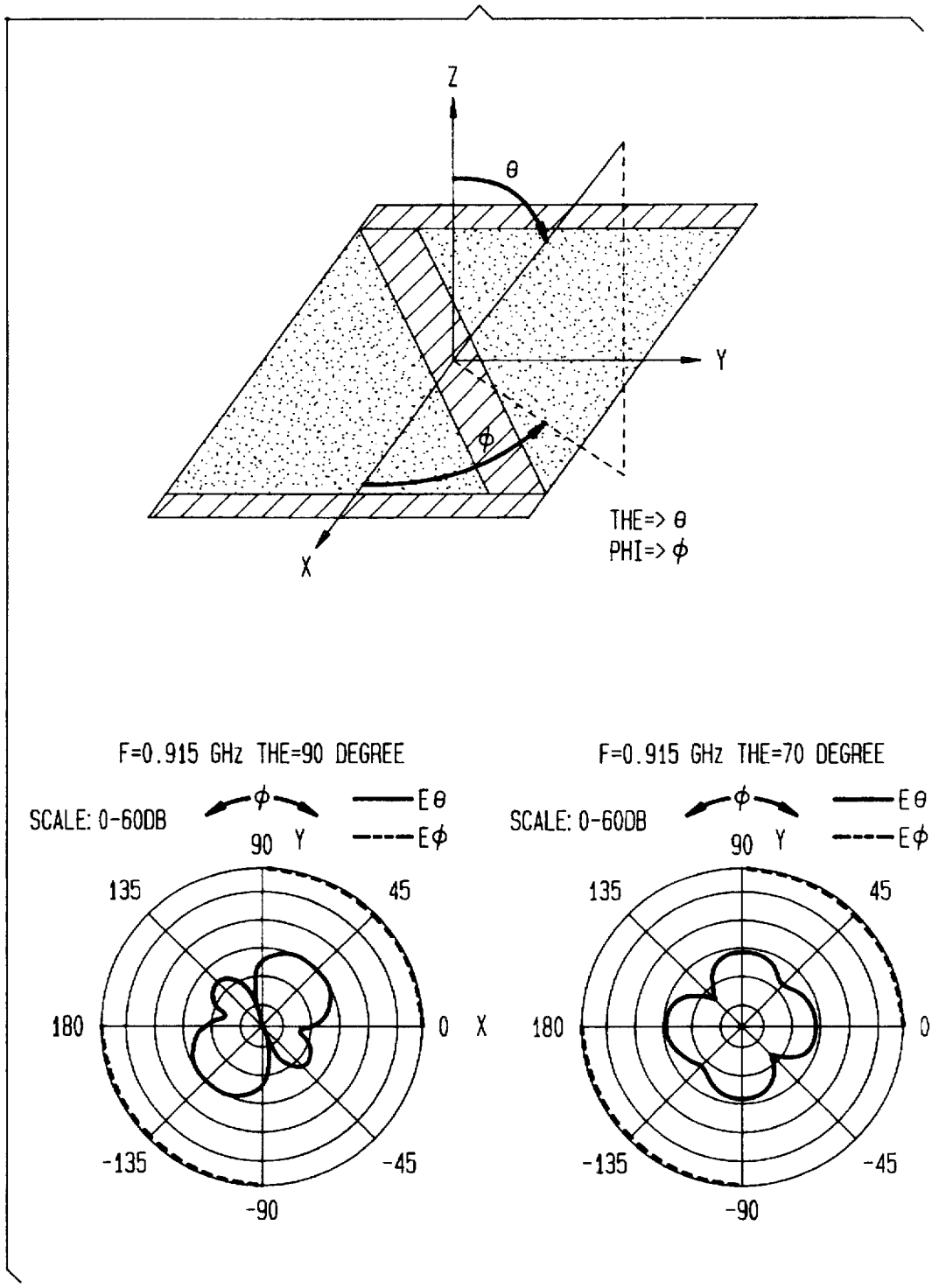
FIGS. 18*a–b* shows the calculated H-plane and E-plane field patterns of a simulated antenna according to an embodiment of the present invention.
Figure 18B:
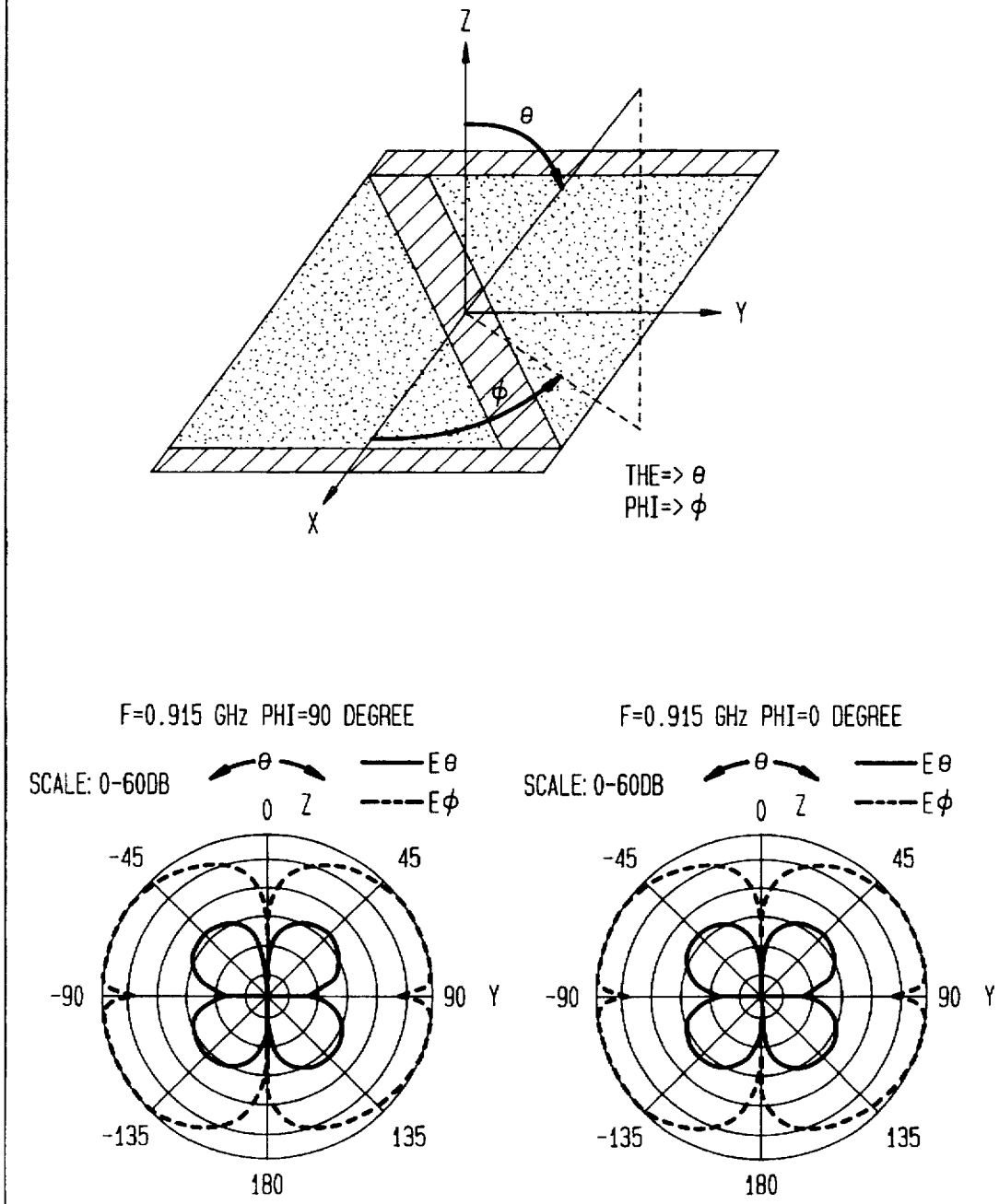

FIG. 17 shows the antenna input standing wave ratio (SWR) as a function of frequency for a simulated antenna 100 having the above dimensions. Note that the central frequency is close to 915 MHZ. FIGS. 18*a–b* show the H-plane and the E-plane radiation patterns for the simulated antenna 100. As expected, the horizontal polarization and the omni-directional pattern on the horizontal plane are observed.

Figure 19:
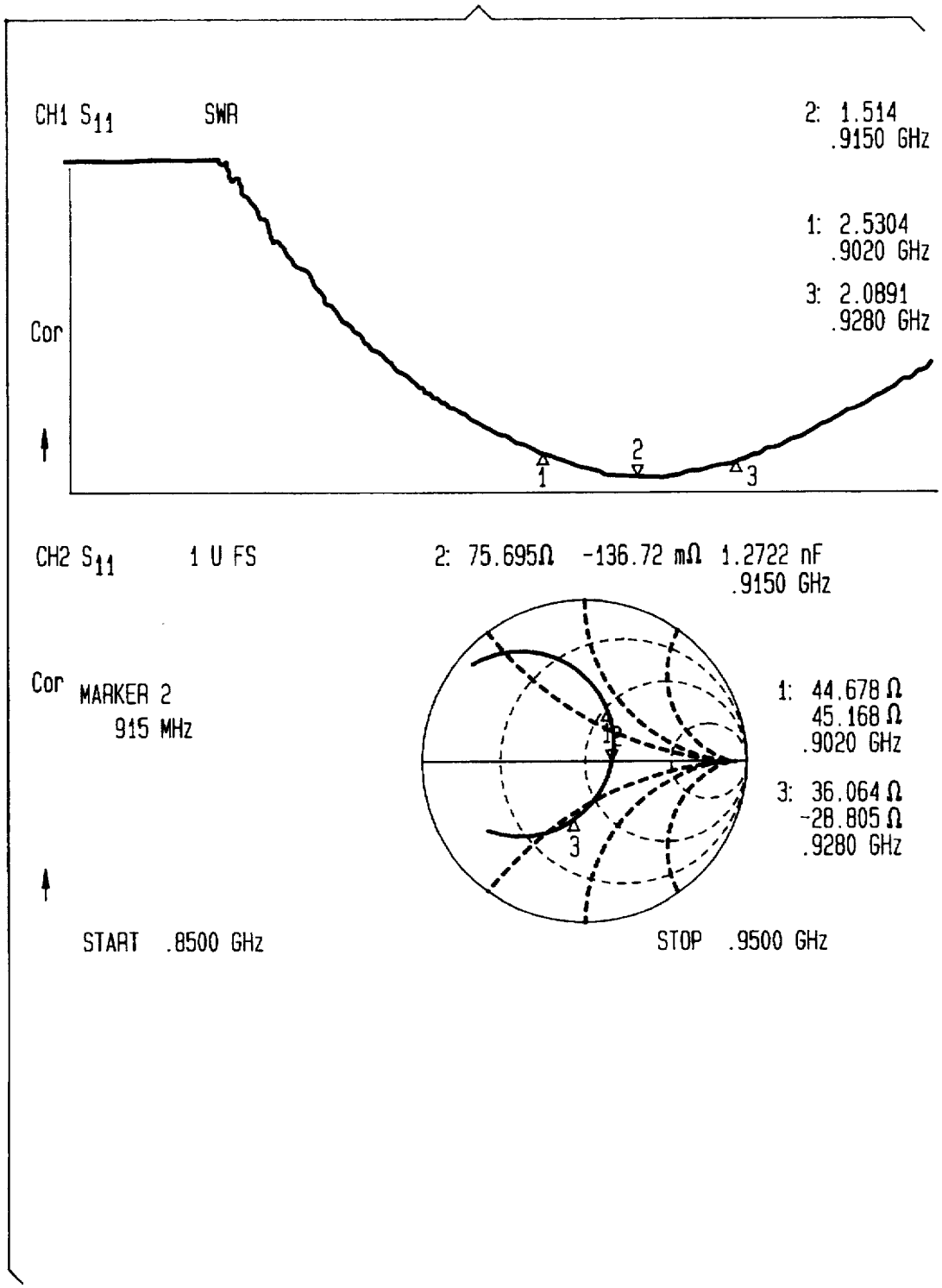
FIG. 19 shows the actually measured SWR of an actual antenna according to an embodiment of the present invention.
Figure 20:
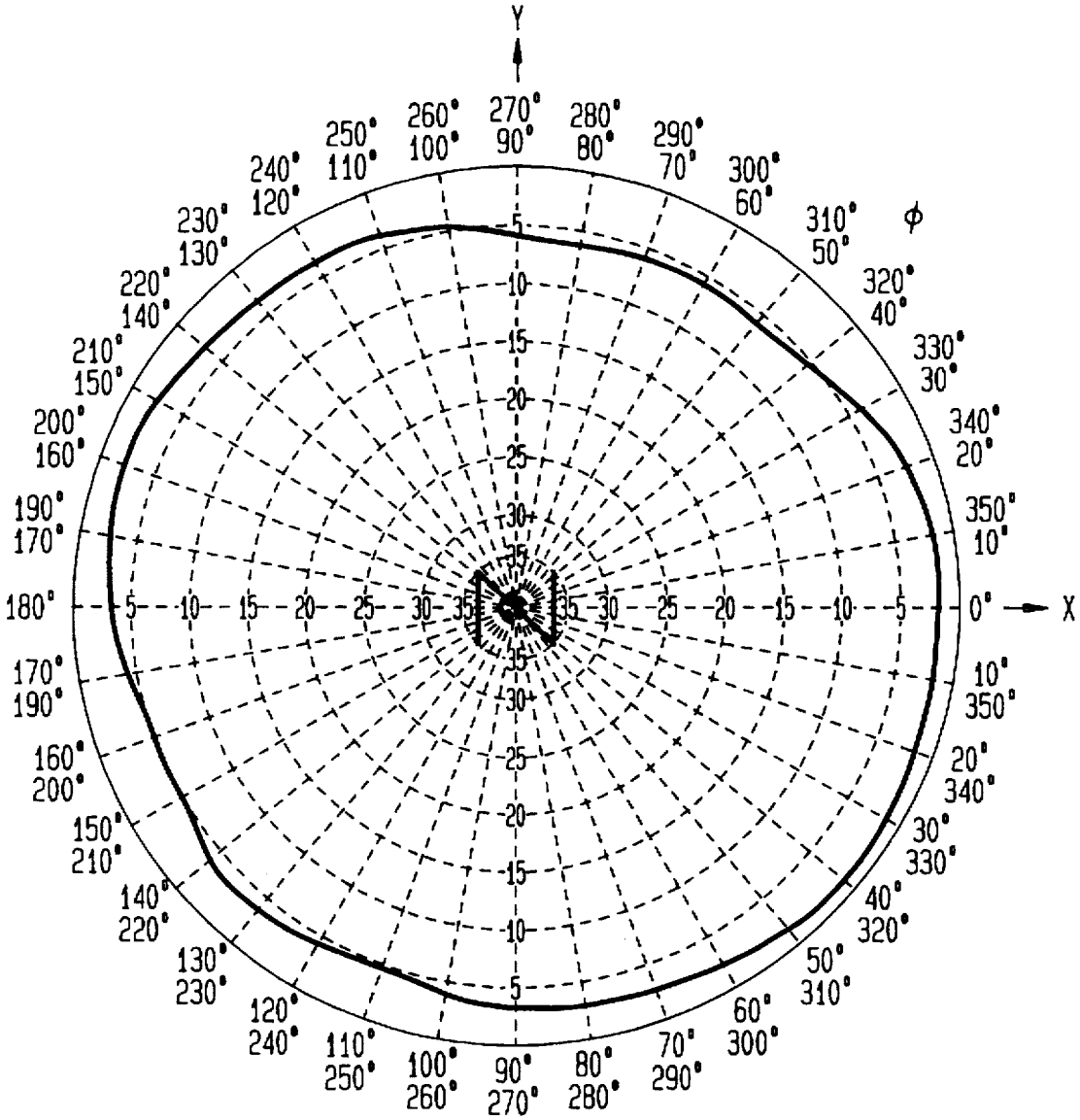
FIG. 20 shows the actually measured H-plane field pattern of an actual antenna according to an embodiment of the present invention.

FIG. 19 shows the measured input SWR of an actual antenna 100. FIG. 20 shows the measured H-plane of the actual antenna 100. In comparing FIGS. 17 and 19 and FIGS. 18*a* and 20, the similarities between the predicted and actually measured SWR and H-plane can be seen.

In short, a horizontally polarized antenna is disclosed. The antenna implements an Alford loop using printed circuit board technology. Thus, the antenna is simple to construct. The antenna has a fairly omni-directional field pattern and horizontal polarization in the horizontal plane.

Finally, the above discussion is intended to be illustrative. Those having ordinary skill in the art may devise numerous alternative embodiments without departing from the spirit and scope of the following claims.

The claimed invention is:

1. An antenna comprising:

a first Z-shaped strip resonant element disposed in a first plane comprising first and second identical sized and shaped, parallel, longitudinal strip segments and a third segment which connects diagonally opposite ends of said first and second strip segments, and a second Z-shaped strip resonant element disposed in a second plane, that is parallel to said first plane, comprising fourth and fifth identical sized and shaped, parallel longitudinal strip segments and a sixth segment, having identical dimensions and an identical shape as said third segment, which connects diagonally opposite ends of said fourth and fifth segments, said second Z-shaped strip resonant element being disposed in said second plane so that said sixth segment entirely overlies said third segment and so that said first, second, fourth and fifth segments overlie a rectangle.

2. The antenna of claim 1 further comprising:

a first feed that is centrally located on said third segment, and a second feed that is centrally located on said sixth segment.

3. The antenna of claim 2 wherein a first signal is applied to said first feed and a second signal equal to an opposite polarity of said first signal is applied to said second feed and wherein said first signal causes an antenna current to flow on said third strip segment in opposing directions away from said first feed towards said diagonally opposing corners of said first and second strip segments and then on said first and second segments to ends of said first and second strip segments opposite said diagonally opposing ends of said first and second strip segments, and wherein said second signal causes an antenna current to flow on said fourth and fifth segments from ends of said fourth and fifth segments opposite said diagonal opposing ends of said fourth and fifth segments towards said diagonally opposing ends of said fourth and fifth strip segments and then on said sixth segment towards said second feed.

4. The antenna of claim 1 further comprising:

a planar dielectric disposed in a third plane that is parallel to said first and second planes, said planar dielectric being disposed between said first and second Z-shaped strip resonant elements.

5. The antenna of claim 4 wherein said dielectric is a printed circuit board substrate and wherein said first and second Z-shaped strip resonant elements are metallic conductors laid out on opposing sides of said printed circuit board.

6. A portable transceiver for providing two-way communication, said transceiver having an antenna comprising:

a first Z-shaped strip resonant element disposed in a first plane comprising first and second identical sized and shaped, parallel, longitudinal strip segments and a third segment which connects diagonally opposite ends of said first and second strip segments, and a second Z-shaped strip resonant element disposed in a second plane, that is parallel to said first plane, comprising fourth and fifth identical sized and shaped, parallel longitudinal strip segments and a sixth segment, having identical dimensions and an identical shape as said third segment, which connects diagonally opposite ends of said fourth and fifth segments, said second Z-shaped strip resonant element being disposed in said second plane so that said sixth segment entirely overlies said third segment and so that said first, second, fourth and fifth segments overlie a rectangle.

* * * * *